US009796009B2

(12) United States Patent
Sandrin et al.

(10) Patent No.: US 9,796,009 B2
(45) Date of Patent: Oct. 24, 2017

(54) WINDING/UNWINDING DEVICE AND METHOD FOR WINDING/ UNWINDING A METAL PRODUCT IN A ROLLING LINE

(75) Inventors: Luca Sandrin, Terzo d'Aquileia (IT); Karl-Heinz Wessel, Dinslaken (DE); Stefano Roiatti, Villaorba di Basiliano (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 589 days.

(21) Appl. No.: 13/519,662

(22) PCT Filed: Dec. 29, 2010

(86) PCT No.: PCT/EP2010/070857

§ 371 (c)(1),
(2), (4) Date: Dec. 7, 2012

(87) PCT Pub. No.: WO2011/080300

PCT Pub. Date: Jul. 7, 2011

(65) Prior Publication Data

US 2013/0068871 A1 Mar. 21, 2013

(30) Foreign Application Priority Data

Dec. 30, 2009 (IT) ..... UD2009A0239

(51) Int. Cl.
*B21C 47/24* (2006.01)
*C21D 9/68* (2006.01)

(52) U.S. Cl.
CPC ..... *B21C 47/24* (2013.01); *B21C 47/245* (2013.01); *C21D 9/68* (2013.01)

(58) Field of Classification Search
CPC ..... C21D 9/68; B21C 47/245; B21C 47/24; B21D 53/88; B21D 5/10; B21D 22/025
(Continued)

(56) References Cited

U.S. PATENT DOCUMENTS 2,169,314 A * 8/1939 Wilson ..... C21D 9/68 148/601
4,123,011 A * 10/1978 Kajiwara ..... B21B 1/28 242/533.7

(Continued)

FOREIGN PATENT DOCUMENTS

DE 19856767 A1 * 5/2000
FR 1435927 6/1966

(Continued)

*Primary Examiner* — James S McClellan
*Assistant Examiner* — Peter Iannuzzi
(74) *Attorney, Agent, or Firm* — Hamre, Schumann, Mueller & Larson, P.C.

(57) ABSTRACT

Device (10) and method for winding/unwinding rolled products (20). The device (10) is interposed between a rolling unit located upstream (102) and a rolling unit located downstream (105). The device (10) comprises a heating furnace (11) and a support structure (16) disposed outside the heating furnace (11). On the support structure (16), substantially in a diametrically opposite position, two winding/unwinding drums (18*a*, 18*b*) are assembled, positioned inside the furnace (11). The support structure (16) is selectively rotating to alternatively dispose a first of the two drums (18*a* or 18*b*) in its winding position or in its unwinding position of a reel (29). A second of the two drums (18*b* or 18*a*) consequently assuming the opposite unwinding or winding position.

9 Claims, 7 Drawing Sheets

(58) Field of Classification Search
USPC ..... 72/146–148, 183, 202, 229
See application file for complete search history.

(56) References Cited

U.S. PATENT DOCUMENTS 4,761,983 A * 8/1988 Ginzburg ..... B21C 47/063 72/148
5,333,366 A * 8/1994 Guse ..... 29/33 C
5,335,713 A * 8/1994 Hoppmann ..... B21B 1/466 164/269
5,778,716 A * 7/1998 Moser ..... 72/202
5,904,313 A * 5/1999 Perret ..... B21C 47/245 242/533.4
6,220,070 B1 * 4/2001 Drigani et al. ..... 72/203
6,273,357 B1 * 8/2001 Figge ..... B21C 47/245 242/533.4
7,401,485 B2 * 7/2008 Peter ..... B21B 38/00 242/362.1
2011/0265592 A1 * 11/2011 Rossigneux ..... B21C 47/245 74/411.5
2012/0227455 A1 * 9/2012 Passoni ..... B21B 1/34 72/128

FOREIGN PATENT DOCUMENTS

FR WO 2009063139 A1 * 5/2009 ..... B21C 47/245
JP 1984-61525 4/1984
JP 61163218 A * 7/1986
JP 1988-268514 11/1988
JP 1998-501469 2/1998
JP 1999-207403 8/1999
JP 1999-254035 9/1999
WO 99/03614 1/1999
WO WO 2009047395 A1 * 4/2009 ..... B21B 38/00
WO WO 2009128380 A1 * 10/2009

* cited by examiner

WINDING/UNWINDING DEVICE AND METHOD FOR WINDING/ UNWINDING A METAL PRODUCT IN A ROLLING LINE

FIELD OF THE INVENTION

The present invention concerns a device and a method for winding/unwinding a semi-worked metal product, for example a flat rolled product exiting from a roughing train, in a rolling line, in particular but not only for flat products such as strip, thin strip or sheet.

In particular the invention concerns a winding/unwinding device, interposed between a roughing train and a finishing train, which can be used both in discontinuous or semi-endless mode, to wind the flat product exiting from the roughing train and then to unwind it so as to feed it to the finishing train, and also in continuous or endless mode, with the flat rolled product passing through the device without interruptions.

The invention is applied on flat rolled products which can have a thickness of less than 30 mm, advantageously comprised between 10 and 30 mm.

BACKGROUND OF THE INVENTION

In rolling lines for strip and sheet, it is known to provide winding/unwinding units, possibly associated with a heating furnace, the function of which is to wind a semi-worked product, for example a slab, exiting from a working step, and then to unwind it to feed it to a subsequent process.

U.S. Pat. No. 5,335,713 describes for example a winding/unwinding device disposed at exit from a continuous casting. The device comprises two reeling stations disposed inside a furnace, which alternately exchange positions so as to be disposed selectively in a first position for winding a slab exiting from the continuous casting, and a second position to feed the slab to a rolling train. The reeling stations each comprise a rotary mandrel on which the slab winds/unwinds.

The device does not provide a passage system which can exclude its functioning in the event that it is desired to make the slab pass without proceeding to winding/unwinding. Moreover, the device does not provide auxiliary means that intervene to facilitate the unwinding of the reel when unwinding is started, thus limiting the use of this solution to determinate thicknesses.

Another disadvantage of the device is that at least one end of the reel is blocked outside the heating furnace, so that it is subjected to an unwanted lowering of the temperature.

The purpose of the invention is to solve the above problems, achieving a device which, functioning in semi-endless mode, allows to selectively wind a complete slab exiting from a roughing train and then unwind it so as to feed it to a finishing train, but which can easily and quickly be configured to function in endless mode, with the continuous passage of the roughed slab from the roughing train to the finishing train.

Another purpose of the invention is to reduce the cycle times required to complete the operations to wind a reel onto a first drum, to unwind the reel from a second drum and to reposition the drums in order to start a new winding cycle of a new reel.

The Applicant has devised, tested and embodied the present invention to overcome these shortcomings of the state of the art and to obtain these and other advantages as shown hereafter.

SUMMARY OF THE INVENTION

The present invention is set forth and characterized in the independent claims, while the dependent claims describe other innovative characteristics of the invention.

According to the present invention, a winding/unwinding device for semi-worked flat rolled products is disposed between two rolling units, for example a roughing unit and a finishing unit, located respectively upstream and downstream of the device.

The function of the winding/unwinding device, in semi-endless mode, is to wind in the form of reel or roll a length of complete slab exiting from a first rolling process, and then to unwind it so as to feed it to a subsequent rolling process downstream.

The slab roughed in the first rolling process is also called transfer bar.

According to a characteristic feature of the present invention, the winding/unwinding device consists of a heating furnace and a support structure disposed outside the heating furnace, wherein two winding/unwinding drums are mounted on the support structure, in a substantially diametrically opposite position, positioned inside the furnace, and wherein the support structure, outside the furnace, is selectively rotating so as to dispose alternately a first of the two drums in its winding position or in its unwinding position, the second of the two drums consequently assuming the opposite unwinding/winding position.

According to another characteristic feature of the present invention, the two winding/unwinding drums are mounted on the support structure so that they are able to assume an inactive position not interfering with the pass-line of the flat rolled product; the device according to the invention also has support and sliding means, able to be selectively activated at least when the drums assume their inactive position, so as to define a pass-line for the flat rolled product in the event that the activation of the winding/unwinding drums is not required.

This can happen, to give a non-restrictive example, if the rolling line is at least temporarily configurable for a so-called endless functioning, that is, without interruptions between casting and rolling.

According to another solution of the invention, the device comprises an extraction unit, able to be selectively activated, suitable to cooperate with the leading end of the full reel at least at the start of the unwinding cycle, in order to promote the operations to start unwinding and accompanying the first segment of transfer bar toward the drawing and guide elements toward the rolling unit disposed downstream.

The two drums each have at least an eyelet to introduce the leading end of the flat rolled product at the start of winding, so that the leading end can be gripped, for a desired segment, stably inside the drum, thus promoting both the start of the winding operation and also the correct tensing and stable maintenance of the reel, also in the wound condition.

According to one solution of the invention, the flat rolled product is wound, after the leading end has been attached while the drum is stationary, at least partly during the step when a first drum is moved from the winding position to the unwinding position, with the simultaneous positioning of the other drum from the unwinding position to the winding position. In particular, in one embodiment of the invention, the movement from the winding position (inlet side) to the unwinding position (exit side) of the winding drum begins not before the unwinding of the reel on the other drum has terminated.

In practice, in this embodiment of the invention, there is only one unwinding position, whereas the winding position passes from the initial one, where the leading end of the transfer bar enters the eyelet of the drum, to a series of subsequent intermediate positions, and then moves to coincide with the unwinding position.

The possibility of moving the drum from the winding position to the unwinding position during the winding of the rolled product considerably reduces the cycle times. Indeed, when the winding of the reel terminates, the full drum is already in the position suitable for the unwinding of the product toward the downstream, whereas the empty drum is already in the position suitable to receive a new rolled product arriving from the equipment upstream.

The reduction in the cycle time allows to use the winding/unwinding device according to the invention even when the distance between the tail end of a first transfer bar and the leading end of a subsequent second transfer bar is very limited.

The device can therefore be used effectively and with great productivity in plants of the rapid type, or when it is desired to keep the winding speed as constant as possible.

The use of a constant winding speed is extremely important when the device is installed immediately downstream of a heating furnace, since it determines a constant passage time of the bar through the furnace, and therefore a more uniform temperature of the material and consequently a greater ease in rolling.

A constant winding speed is also important in applications different than those using a heating furnace upstream the winding/unwinding device, for example in cooling treatments, (e.g. after the casting), or in pickling or other chemical processes.

The uniform temperature over the length of the material is also guaranteed by the fact that, with the device according to the invention, the material is completely wound onto the drum, including its tail end, which means that the entire transfer bar is located inside the furnace, so that the tail end of the transfer bar does not go cool.

In another variant of the invention, there may not be a single unwinding position either. In fact, the movement of the two drums to exchange position may take place before the unwinding is totally completed. In this way, the empty drum may be prepared for a new winding cycle in a shorter time, since the space that the empty drum has to travel from the moment the unwinding ends to the moment the new winding starts is reduced.

Therefore, in a preferred solution, the winding step is completed with the drum already positioned in the unwinding position.

According to a possible form of embodiment of the invention, in the final winding step of the reel the extraction unit can be used to accompany and guide the tail end of the reel being wound. The tail end of the reel being wound therefore becomes the leading end of the reel in the subsequent unwinding step.

According to a variant of the invention, the unwinding operation is performed at a speed greater than the winding speed, which allows to free the mandrel more quickly and to take it to the winding position before completing the winding onto the other mandrel; in this way it is possible to manage subsequent transfer bars that have a reduced phase difference time between them.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

With reference to the attached drawings, the number 10 denotes in its entirety a device for winding/unwinding a semi-worked flat rolled product 20 in an intermediate step of a rolling process for strip or sheet.

Figure 1:
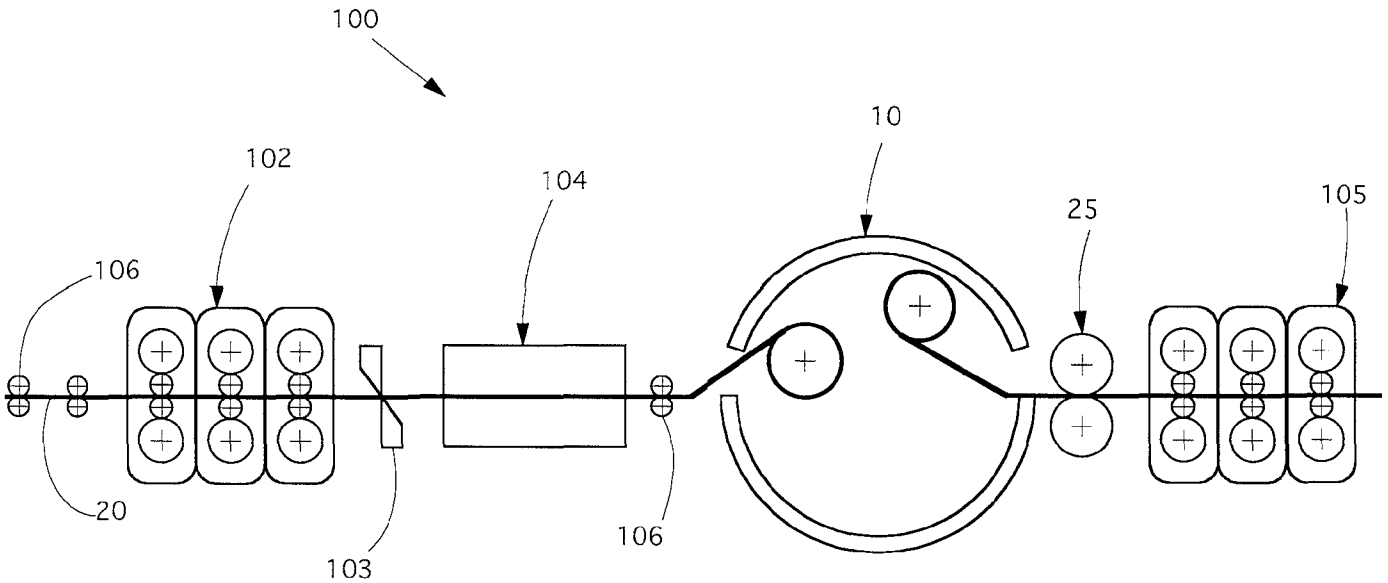
FIG. 1 is a view of the overall lay-out of a rolling line in which the device according to the present invention is applied.

The device 10, with reference to FIG. 1, is inserted in a rolling line 100 comprising a continuous casting device (not shown) for conventional slabs or thin slabs, a roughing rolling unit 102, a shears 103 to obtain in semi-endless mode lengths of slab of the desired size, a heating and equalization furnace 104, the device 10, an extraction unit 25, a finishing rolling train 105, pinch-roll type drawing devices 106 and conventional cooling and winding devices for the strip (not shown).

Figure 2:
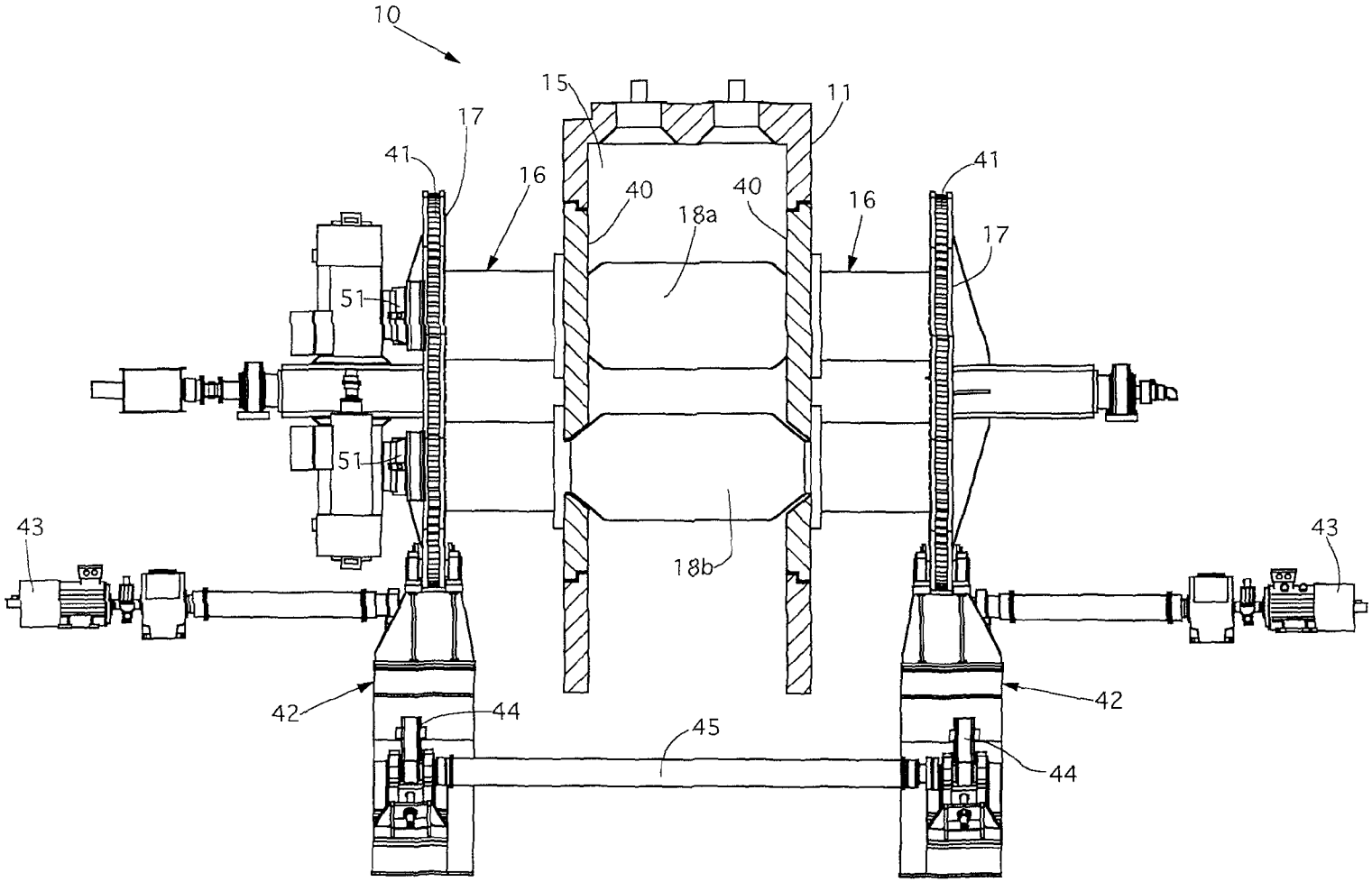
FIG. 2 is a view in section of the device for winding/unwinding a metal product according to the invention.

With reference to FIGS. 3 to 9, the device 10 comprises, as essential elements, a furnace 11 equipped with an inlet door 12 and an exit door 13, selectively movable depending on the step of the winding/unwinding cycle in progress. The furnace 11, provided in known manner with a chimney 14 to discharge the fumes, defines a heated internal volume 15 which houses two motorized winding drums or mandrels, respectively 18*a* and 18*b*. The drums are mounted on a support structure 16, outside the furnace 11, in this case conformed as a rotating disc 17. FIG. 2 shows the support structure 16 comprising two rotating discs 17 to which are attached the respective ends of the drums 18*a* and 18*b*.

In order to minimize heat losses and to allow the drums 18*a*, 18*b* to rotate, the furnace 11 comprises covers 40 that are made to rotate together with the discs 17.

The discs 17 each comprise a wheel with stakes 41 which engages on respective movement devices 42. Each movement device 42 of the support structure 16 comprises a motor 43 and a reduction unit 44.

The two reduction units 44 are synchronized mechanically by means of a transmission shaft 45, which provides to transfer the torque to the wheel with stakes 41.

The motors 43 of the movement device 42 must be synchronized electrically so that they both provide at the same moment the same torque and the same speed of rotation.

Motor elements 51 are mounted directly on the discs 17 and provide to move the two drums 18*a* and 18*b*.

Figure 3:
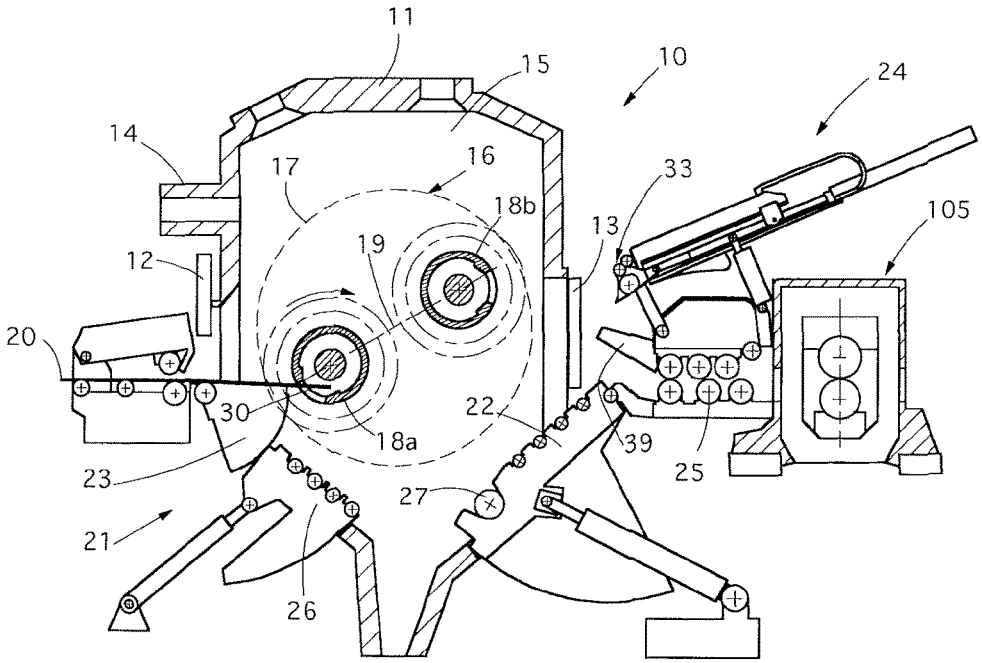
FIGS. 3-9 show in sequence the various positions that the various components of the winding/unwinding device according to the invention can assume, in relation to the step of the cycle in progress.
Figure 4:
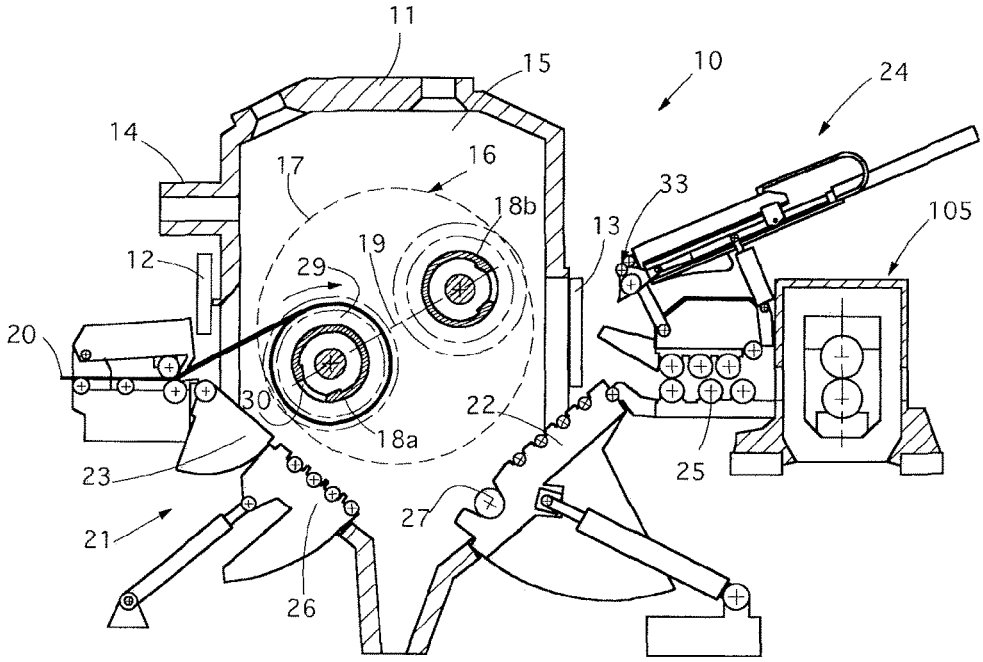
Figure 5:
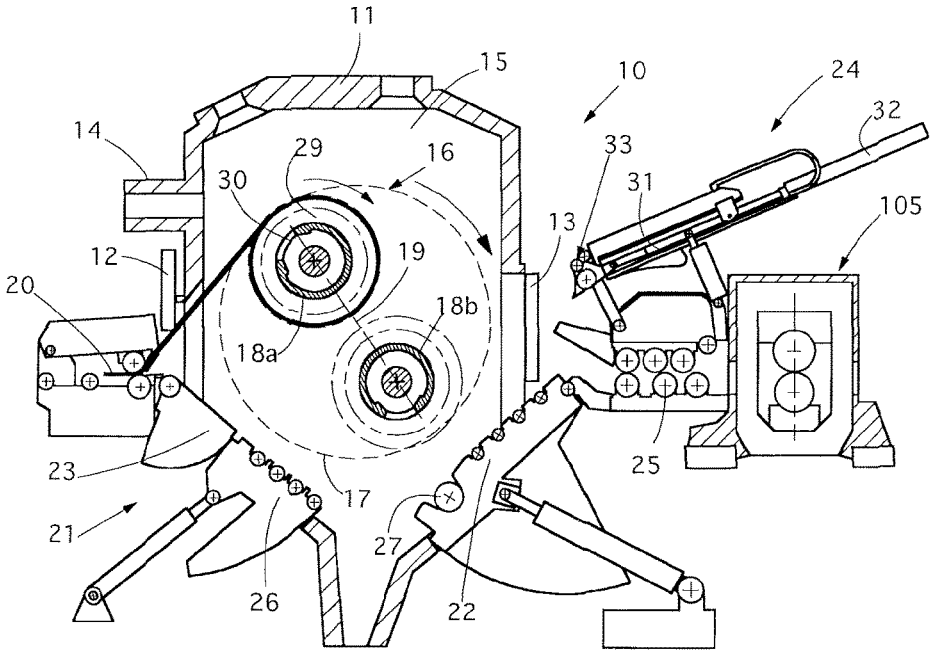
Figure 6:
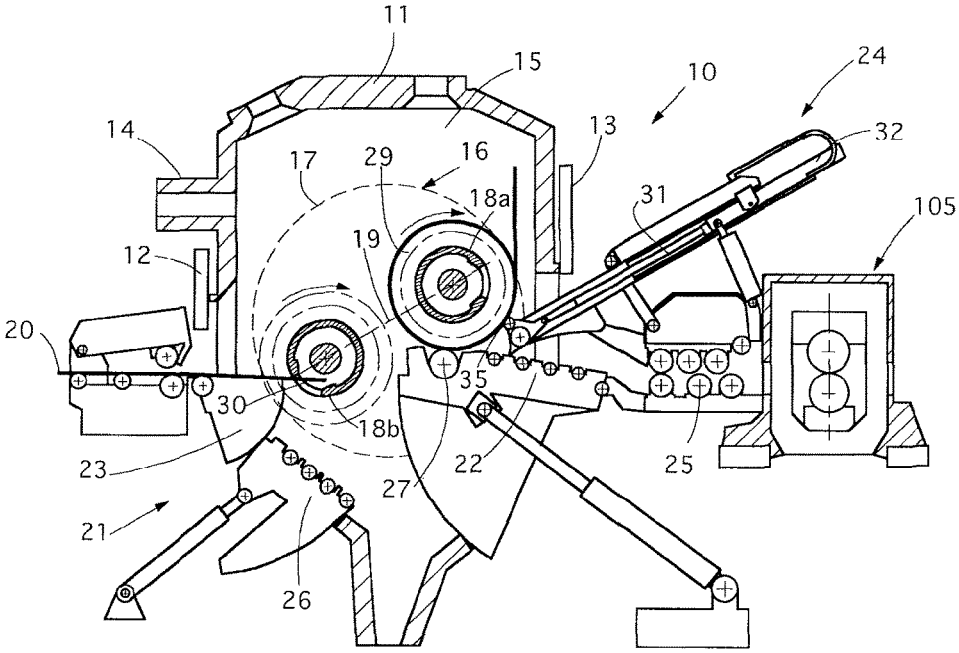

In the solution shown in FIG. 3, to give a non-restrictive example, the centers of the motorized drums 18*a*, 18*b* are disposed along a diameter 19 of the rotary disc 17 in a diametrically opposite position; when the diameter 19 joining the centers of the drums 18*a*, 18*b* is disposed horizontal, it lies in this case in a position of non-interference and above the pass-line of the flat rolled product 20, for the reasons discussed in detail hereafter.

The device 10 also comprises an inlet table 21 and an exit table 22, selectively movable with respect to the rotary disc 17, and hence to the drums 18*a*, 18*b*, in relation to the different functions that they have to perform as the winding/unwinding cycle progresses.

The inlet table 21 comprises a first inlet segment, or feeding table, 23, with a flat surface, the function of which is substantially to guide the leading end of the rolled product 20 into an introduction eyelet 30 with which the drums 18*a*, 18*b* are provided, and a second segment, or entry table, 26, substantially mobile, on whose surface a plurality of rolls may be present. The exit table 22 is also selectively mobile, and may also have rolls 28 (FIG. 9) which define its upper surface. As an alternative to the rolls 28, according to another form of embodiment, sliding guides may be present, both on the inlet table 21 and the exit table 22.

On the exit table 22 there is in any case present in the initial part a big motorized roll 27 or snubber roll, which is used during the final winding step and/or during the unwinding of the transfer bar 20.

The device 10 also comprises an extractor element 24, disposed on the exit side of the furnace 11 and able to be selectively activated to help to open the reel at the start of the unwinding step.

Upstream and downstream of the device 10 there are drawing devices of a known type, for example pinch rolls 106 or suchlike.

An extraction/straightening unit 25 is provided in the case shown here, downstream of the device 10, in order to perform one or both of the following functions:

to straighten the tail end of the transfer bar 20 (which constitutes the leading end in the winding step) bent in the start of winding step when it is introduced into the eyelet 30 of the drum 18*a*-18*b;* to remove the curvature of the transfer bar 20 when its own weight and the low mechanical characteristics due to the high temperatures are not sufficient to keep the leading end of the transfer bar 20 low.

In fact, if the leading end were high there would be a risk of jamming in the machine downstream during the entry step.

Figure 7:
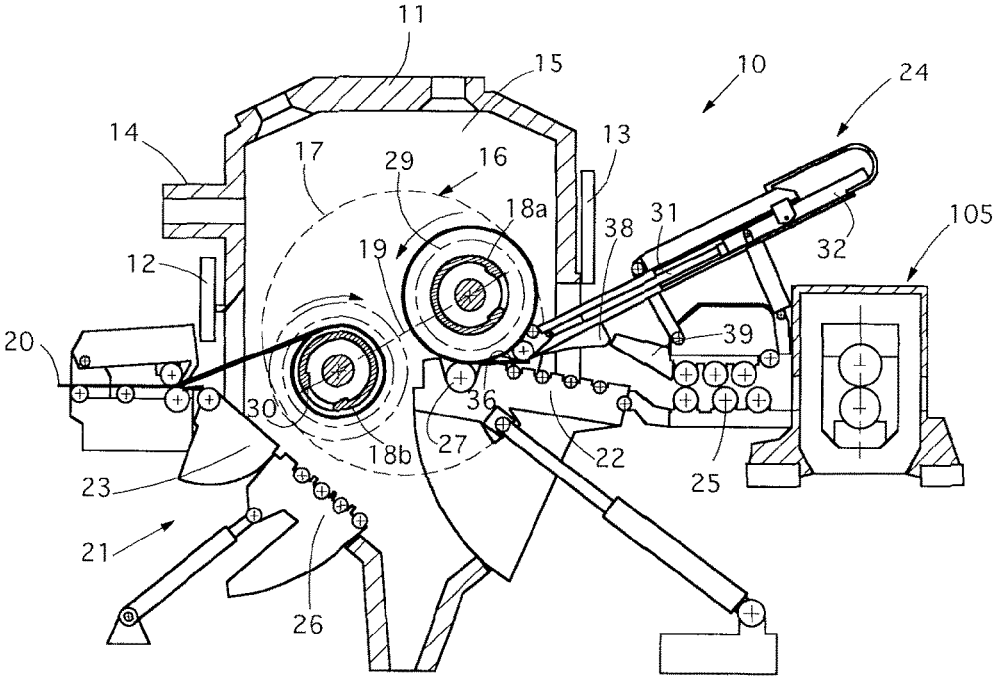

In order to minimize these problems, the extraction/straightening unit 25 comprises a conveyor 39, which facilitates the correct insertion of the transfer bar 20 into the extraction/straightening unit 25 (FIG. 7).

With reference to FIGS. 3-9, we shall now describe the operating steps of the winding/unwinding cycles in which the device 10 is used.

In FIG. 3, the leading end of the transfer bar 20 is guided inside the eyelet 30 of the drum 18*a*, disposed in the winding position. The inlet door 12 of the furnace 11 is obviously open, whereas the exit door 13 is closed so as to reduce to a minimum the losses of temperature from inside the furnace 11.

The drum 18*b* is in the diametrically opposite position and at the start of the casting cycle has no reel to unwind. The leading end of the transfer bar 20 is introduced for a desired segment with the drum 18*a* stationary, then the drum 18*a*, driven by the motor, starts to rotate on its own axis so as to start winding the first transfer bar 20.

The first segment 23 of the inlet table 21 is still up to support the head of the bar 20, while the second segment 26 is moved down. After few coils being wound on the drum 18*a*, also the first segment 23 of the inlet table 21 is moved down.

After having reached a certain diameter of the reel 29 on the drum 18*a* stationary in position (FIG. 4), for example 45 wraps, the disc 17 also starts to rotate (FIG. 5), so that the two drums 18*a*, 18*b* start to invert their respective positions, the drum 18*a* continuing to rotate on its axis to continue and complete the winding of the reel 29, the opposite drum 18*b* moving progressively toward the winding position.

When the reel 29 approaches the final winding step (FIG. 6), and more particularly when the tail end of the transfer bar 20 exits from the pinch roll 106 upstream, so that the drawing is lost, the following operations occur, substantially simultaneously:

the exit door 13 of the furnace 11 opens;

the exit table 22 is raised so that the snubber roll 27 goes into contact with the reel 29;

also the first segment 23 of the inlet table 21 is raised in a high position, in order to protect the drum and to support the tail of the transfer-bar 20; then, when the drum 18*b* has reached the winding position, the first segment 23 is moved in the winding position so as to allow the head of the transfer-bar 20 to be fed in the drum;

the extraction unit 24 is driven.

The extraction unit 24 comprises an actuator 32 suitable to drive a rod 31 at the end of which a presser/extractor device 33 is mounted.

More particularly, the presser/extractor device 33 consists of a frame 34, substantially triangular in shape, on a first top of which an idle presser roll 35 is mounted, on a second top of which an extractor element 36 is mounted, conformed substantially as a hook.

Figure 10:
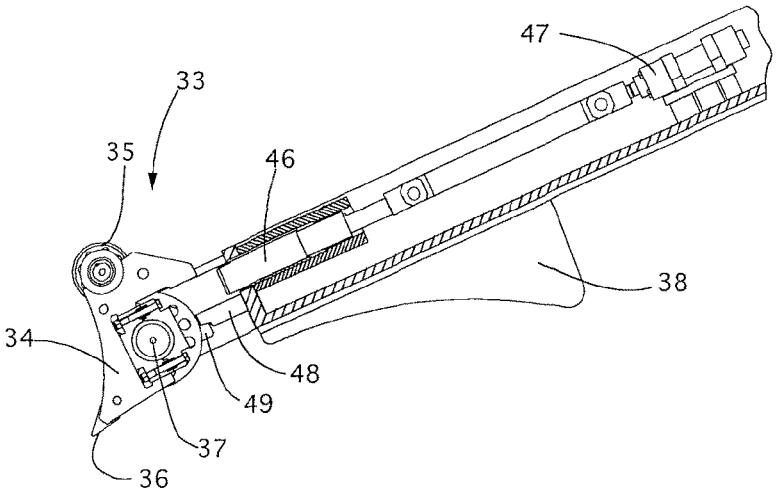
FIG. 10 shows an enlarged detail of an extraction unit.

With reference to FIG. 10, it can be seen how the frame 34 is free to rotate around the pin 37. The frame 34 is balanced so that its mass barycenter is disposed so as to return it to the inactive position, with the presser roll 35 located forward with respect to the extractor element 36.

An abutment element 48, located substantially as an extension of the rod 31, upstream of the frame 34, and a striker element 49, attached on the frame 34, limit its spontaneous rotation in one direction.

Figure 11:
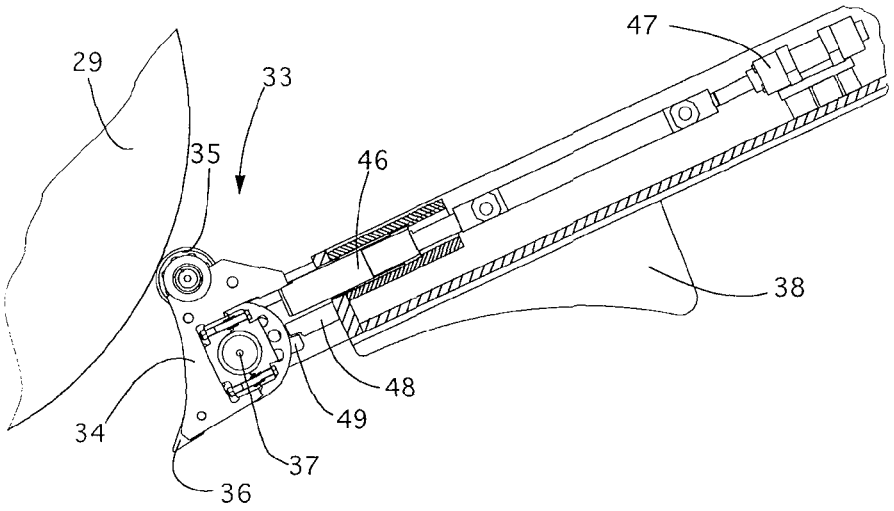
FIGS. 11-12 show two positions that the components of the extraction unit in FIG. 10 can assume.

It is possible, in some steps, with a clamping element 46 driven by a relative hydraulic cylinder 47, to keep the frame 34 in the inactive position as above, preventing it from rotating in the other direction. This condition is necessary when the presser roll 35 is thrust against the surface of the reel 29, as shown in FIG. 11.

Figure 12:
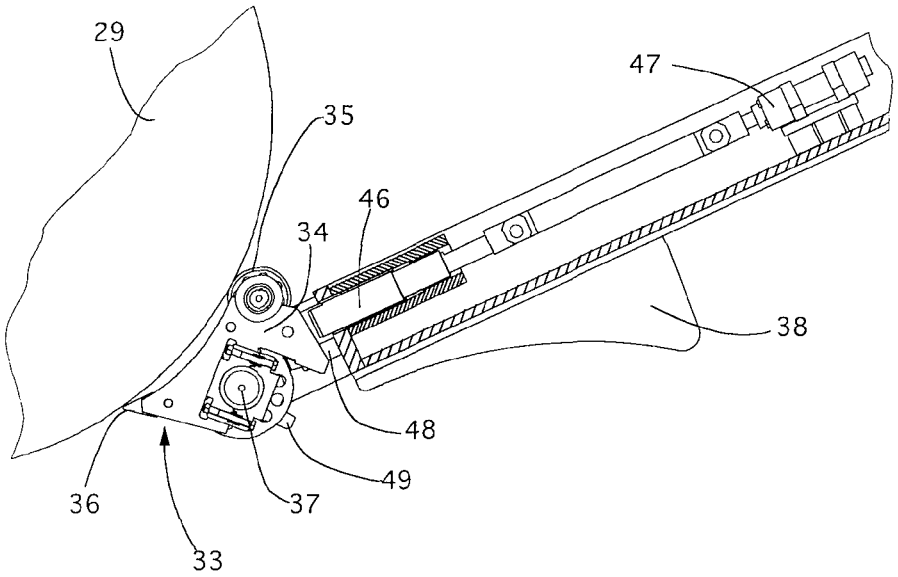

The moment the reel 29 begins unwinding, the clamping element 46 is retracted by means of the hydraulic cylinder 47 (FIG. 12).

The frame 34, due to the effect of the pressure exerted by the reel 29 on the presser roll 35, rotates around the pin 37 and takes the extractor element 36 into contact with the surface of the reel 29.

In particular, in the first step when the extraction unit 24 is driven (FIG. 6), the presser/extractor device 33, by means of the actuator 32, is made to advance until it takes the presser roll 35 into contact with the reel 29, so that the last segment of the transfer bar 20, that is, the tail end of the reel 29, adheres to the last spirals already wound.

In this step, the winding of a new transfer bar 20 has already started on the free drum 18*b*, disposed in the winding position, substantially without any downtimes.

The winding step onto the drum 18*a* terminates with the tail end of the reel 29 positioned between the presser roll 35 and the snubber roll 27.

When the unwinding of the completed reel 29 from the drum 18*a* has to be started (FIG. 7), and before the drum 18*a* starts to rotate in the unwinding direction, the clamping element 46 is retracted so that the extractor element 36, rotating, spontaneously moves into contact with the surface of the reel 29, facilitating the unrolling thereof (see in particular the enlarged detail of FIG. 10).

Furthermore, below the presser/extractor device 33, the extractor element 24 also has a shaped profile 38 which, in cooperation with the extractor element 36, creates a path to guide the leading end of the transfer bar 20 unrolling from the reel 29 and inserts it in the inlet of the extraction/straightening device 25.

Figure 8:
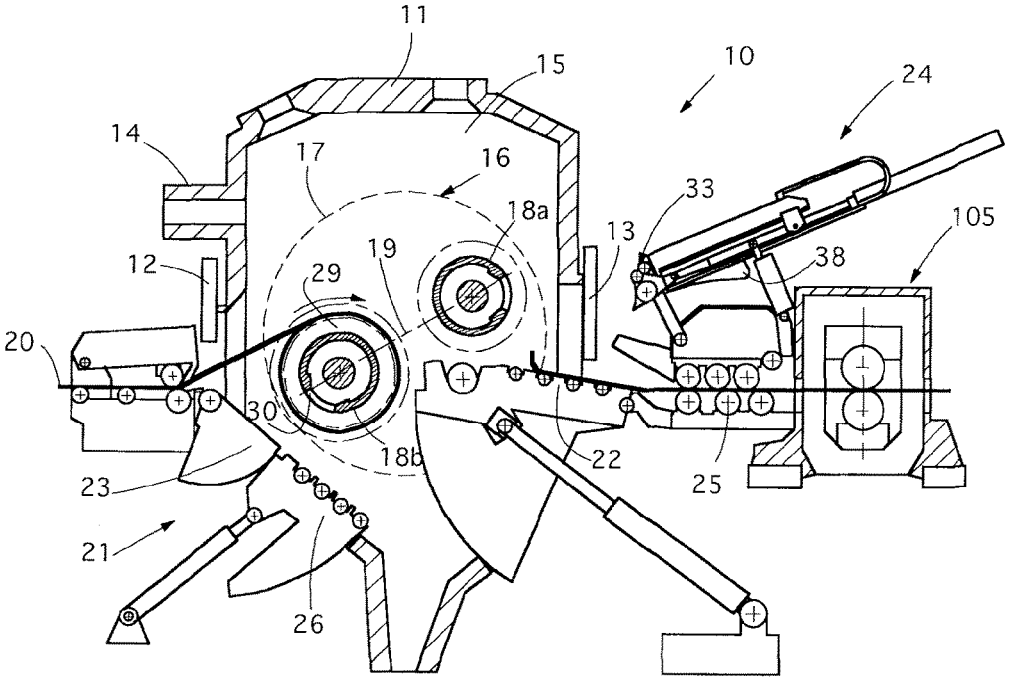

As soon as the transfer bar 20 is gripped by the extraction/straightening device 25, the extraction unit 24 retreats, and the exit door 13 of the furnace 11 closes, even if not completely, leaving only the space necessary for the reel 29 to unroll (FIG. 8).

According to a variant not shown here, during the unwinding step, the drum 18*b* is progressively moved towards an intermediate position between the unwinding position and the winding position, and the drum 18*a* is positioned at the same time in an intermediate position between the winding position and the unwinding position.

In this position, the exit table 22 may be positioned in a raised position to support the transfer-bar during the unwinding.

This variant allows to reduce the cycle times, since the unwinding operation is performed by moving progressively the full drum towards its position of winding of a new reel, thus providing an empty drum for a new winding cycle in a shorter time.

Figure 9:
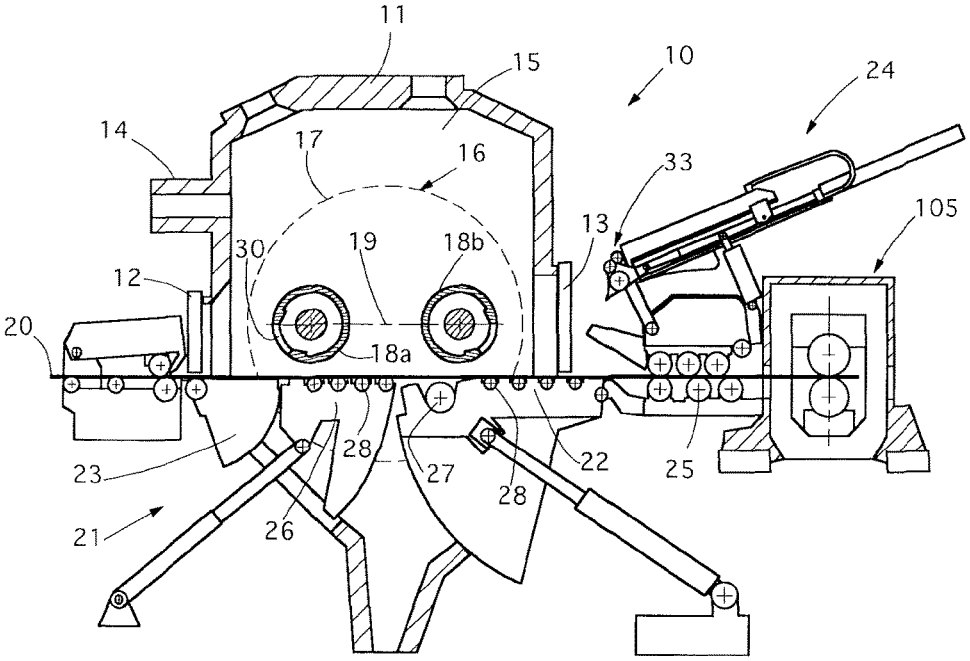

FIG. 9 shows the case where the transfer bar 20 passes through the winding/unwinding device 10 without any intervention by the latter, this solution being provided when the rolling line 100 is functioning in endless mode.

As said, in this case the two drums 18*a*, 18*b* are disposed with the respective centers lying on a substantially horizontal plane and above the pass-line of the transfer bar 20.

To allow the bar 20 to pass, both the inlet table 21, with its two elements 23 and 26, and also the exit table 22, are taken to the operating position so that the bar 20 can be made to transit on the rolls 28, if present, on the second segment 26 of the inlet table 23 and on the exit table 22, so as to guide it toward the extraction/straightening device 25.

Advantageously, in endless mode the passage of the transfer bar 20 from the roughing unit 102 to the finishing unit 105 does not entail any losses in temperature in passing through the winding/unwinding device 10, since the furnace 11 remains active and keeps the transfer bar 20 at a temperature suitable for the subsequent finishing rolling.

Modifications and variants may be made to the device and method for winding/unwinding a rolled product as described heretofore, all coming within the field of protection as defined by the attached claims.

The invention claimed is:

1. A winding/unwinding device for rolled products, the device being interposed between a rolling unit configured for reducing a thickness of the rolled products located upstream of the device and another rolling unit configured for reducing the thickness of the rolled products located downstream of the winding/unwinding device, the winding/unwinding device comprising:

a heating furnace; and a support structure disposed outside the heating furnace, two winding/unwinding drums being assembled on the support structure in a substantially diametrically opposite position, the two winding/unwinding drums being positioned inside the heating furnace, the support structure comprising:

a first selectively rotating disc connected to a first lateral cover of the heating furnace so that the first selectively rotating disc and the first lateral cover are rotatable together, and a second selectively rotating disc connected to a second lateral cover of the heating furnace so that the second selectively rotating disc and the second lateral cover are rotatable together, the first lateral cover and the second lateral cover are disposed at opposing sides of the heating furnace, and the first selectively rotating disc and the second selectively rotating disc are also disposed at the opposing sides of the heating furnace, and the first lateral cover and the second lateral cover are at opposing sides of both of the two winding/unwinding drums, alternatively disposing a first of the two winding/unwinding drums in a winding position or in an unwinding position, and a second of the two winding/unwinding drums consequently assuming an unwinding or winding position that is different from the winding position or unwinding position of the first of the two winding/unwinding drums, the first selectively rotating disc and the second selectively rotating disc engaged by movement devices, the movement devices each comprising a motor and a reduction unit, the reduction units being mechanically synchronized via a transmission shaft, and the motors being electrically synchronized.

2. The winding/unwinding device as in claim 1, wherein the two winding/unwinding drums are assembled on the support structure so as to be able to assume an inactive position not interfering with a pass-line of a flat rolled product.

3. The winding/unwinding device as in claim 2, wherein the device further comprises support and sliding means, selectively activatable at least in a moment when the two winding/unwinding drums assume the inactive position, to define the pass-line for the flat rolled product when activation of the two winding/unwinding drums is not required.

4. The winding/unwinding device as in claim 1, further comprising an extraction unit, selectively activatable, suitable to cooperate with a leading end of a full reel at least at a beginning of an unwinding cycle, in order to facilitate operations to start unwinding and accompanying a first segment of bar toward drawing and guide elements toward the rolling unit located downstream of the device.

5. The winding/unwinding device as in claim 4, wherein the extraction unit comprises a presser/extractor device having at least two operating positions, a first position in which a presser roller of the presser/extractor device is disposed in contact with the reel, so that a last segment of the rolled product adheres to last coils of the rolled product already wound into the reel, and a second position in which an extractor element, formed substantially as a hook shape, is disposed in contact with a wound end of the reel, facilitating unrolling thereof.

6. The winding/unwinding device as in claim 1, wherein the two winding/unwinding drums each have at least an introduction eyelet to introduce a leading end of the rolled product at a beginning of a winding step, so that the leading end of the rolled product is held for a desired segment of the rolled product, in a stable manner inside each of the two winding/unwinding drums.

7. A method for winding/unwinding a rolled product, interposed between at least a rolling unit located upstream and at least a rolling unit located downstream, in a winding/ unwinding device as in claim 1, wherein the two winding/unwinding drums are disposable in a first position in which a first winding/unwinding drum faces toward the rolling unit located upstream and is suitable to wind a reel, and the first winding/unwinding drum faces toward the rolling unit located downstream and is suitable to unwind the reel, a second position in which the two winding/unwinding drums invert their position, and a third position in which the two winding/unwinding drums are disposed in a position of non-interference with a pass-line of the rolled product so as to allow the rolled product to pass through the device without interfering with the two winding/unwinding drums, wherein at least part of the winding of the reel onto one of the two winding/unwinding drums occurs while the one of the two winding/unwinding drums moves from the first winding position to the second unwinding position.

8. The method as in claim 7, wherein in an unwinding step of the reel by one or the other of the two winding/unwinding drums, the method provides at least a step in which an extraction unit having at least an extractor element is brought into contact with a leading end of the reel in order to facilitate unwinding thereof.

9. The method as in claim 7, wherein at least part of the unwinding of the reel occurs while the one of the two winding/unwinding drums is moving from an unwinding position to a winding position.

* * * * *